US009829227B2

(12) United States Patent
Izaki et al.

(10) Patent No.: US 9,829,227 B2
(45) Date of Patent: Nov. 28, 2017

(54) HEAT EXCHANGER AND REFRIGERATION CYCLE APPARATUS INCLUDING THE SAME

(71) Applicant: Mitsubishi Electric Corporation, Tokyo (JP)

(72) Inventors: Tomonobu Izaki, Tokyo (JP); Masahiko Takagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 183 days.

(21) Appl. No.: 14/872,437

(22) Filed: Oct. 1, 2015

(65) Prior Publication Data

US 2016/0109169 A1 Apr. 21, 2016

(30) Foreign Application Priority Data

Oct. 15, 2014 (JP) ..... 2014-210739

(51) Int. Cl.

| | |
|---|---|
| ***F25B 39/02*** | (2006.01) |
| ***F25B 41/06*** | (2006.01) |
| ***F28F 9/02*** | (2006.01) |

(52) U.S. Cl.

CPC ..... *F25B 39/028* (2013.01); *F25B 41/067* (2013.01); *F28F 9/0282* (2013.01); *F25B 2341/0661* (2013.01)

(58) Field of Classification Search

USPC ..... 62/525

See application file for complete search history.

(56) References Cited

U.S. PATENT DOCUMENTS

| | | | | |
|---|---|---|---|---|
| 4,803,484 | A * | 2/1989 | Schutrum | G01R 11/02 324/96 |
| 4,803,848 | A * | 2/1989 | LaBrecque | F25B 1/00 62/173 |
| 4,955,210 | A * | 9/1990 | Hansen | F25B 39/028 62/511 |

(Continued)

FOREIGN PATENT DOCUMENTS

| | | | |
|---|---|---|---|
| EP | 2 578 967 | A2 | 4/2013 |
| JP | S60-251350 | A | 12/1985 |
| JP | H07-120107 | A | 5/1995 |

(Continued)

OTHER PUBLICATIONS

JP 2010-133644 Machine Translation English—Retrieved May 2017.*

(Continued)

*Primary Examiner* — Len Tran
*Assistant Examiner* — Jenna M Hopkins
(74) *Attorney, Agent, or Firm* — Posz Law Group, PLC

(57) ABSTRACT

A heat exchanger includes a plurality of refrigerant flow paths separated by a distributor and is configured to allow a refrigerant inflow amount to each of the plurality of refrigerant flow paths to be adjusted by a pressure loss in a corresponding one of a plurality of capillaries connected between the distributor and the plurality of refrigerant flow paths. Inner diameters of the plurality of capillaries are limited to two types. An inner diameter of one type of the plurality of capillaries having a larger inner diameter is 1.3 to 1.6 times larger than an inner diameter of an other type of the plurality of capillaries having a smaller inner diameter.

10 Claims, 3 Drawing Sheets

(56) References Cited

U.S. PATENT DOCUMENTS

| | | | | |
|---|---|---|---|---|
| 7,143,593 | B2 * | 12/2006 | Yamasaki | F25B 1/10 62/197 |
| 2013/0186129 | A1 * | 7/2013 | Bae | F25D 11/00 62/498 |

FOREIGN PATENT DOCUMENTS

| | | | | |
|---|---|---|---|---|
| JP | H10-267469 | A | | 10/1998 |
| JP | 2001124453 | A | * | 5/2001 |
| JP | 2010-133644 | A | | 6/2010 |
| JP | 2011-089710 | A | | 5/2011 |

OTHER PUBLICATIONS

JPH07-120107 Machine Translation English—Retrieved May 2017.*
JPH10-267469 Machine Translation English—Retrieved May 2017.*
JP2010-133644 Machine Translation English—Retrieved May 2017.*
JP2001-124453 Machine Translation English—Retrieved May 2017.*
JP2011-089710 Machine Translation English—Retrieved May 2017.*
JPS60-251350 Machine Translation English—Retrieved May 2017.*
Extended European Search Report dated Feb. 26, 2016 issued in corresponding EP patent application No. 15189096.9.
Office action dated Mar. 21, 2017 in the corresponding JP patent application No. 2014-210739 (with English translation).
Office Action dated Jul. 3, 2017 in corresponding CN patent application No. 201510850057.0 (and English translation).

* cited by examiner

FIG. 2

| | HEAT EXCHANGE AMOUNT | COMPARATIVE EXAMPLE A | | EXAMPLE OF EMBODIMENT | | COMPARATIVE EXAMPLE B | |
|---|---|---|---|---|---|---|---|
| | | CAPILLARY INNER DIAMETER RATIO | CAPILLARY LENGTH RATIO | CAPILLARY INNER DIAMETER RATIO | CAPILLARY LENGTH RATIO | CAPILLARY INNER DIAMETER RATIO | CAPILLARY LENGTH RATIO |
| HEAT TRANSFER TUBE 1a | 30% | 1.0 | 1.0 | 1.6 | 1.0 | 1.8 | 1.8 |
| HEAT TRANSFER TUBE 1b | 25% | 1.0 | 1.4 | 1.6 | 1.5 | 1.8 | 2.6 |
| HEAT TRANSFER TUBE 1c | 20% | 1.0 | 2.3 | 1.6 | 2.3 | 1.8 | 4.1 |
| HEAT TRANSFER TUBE 1d | 15% | 1.0 | 4.0 | 1.6 | 4.1 | 1.8 | 7.2 |
| HEAT TRANSFER TUBE 1e | 10% | 1.0 | 9.0 | 1.0 | 1.0 | 1.0 | 1.0 |

HEAT EXCHANGER AND REFRIGERATION CYCLE APPARATUS INCLUDING THE SAME

TECHNICAL FIELD

The present invention relates to a heat exchanger including a plurality of refrigerant flow paths and adjusting the inflow amounts of refrigerant into the refrigerant flow paths by the pressure losses of a plurality of capillaries connected between a distributor and the refrigerant flow paths, and to a refrigeration cycle apparatus including the heat exchanger.

BACKGROUND ART

There has hitherto been known a heat exchanger in which a refrigerant flow path is separated into a plurality of refrigerant flow paths by a distributor to reduce the pressure loss during passage through the heat exchanger. In such a heat exchanger, the inflow amounts of refrigerant into refrigerant flow paths are adjusted by the lengths and inner diameters of a plurality of capillaries connected between a distributor and the refrigerant flow paths (see, for example, Patent Literature 1).

CITATION LIST

Patent Literature

Patent Literature 1: Japanese Unexamined Patent Application Publication No. 7-120107 (FIGS. 1 to 3)

SUMMARY OF INVENTION

Technical Problem

In many cases, the separated refrigerant flow paths in the heat exchanger are influenced by variations in the inflow amount of a medium with which the refrigerant exchanges heat and routing and lengths of the refrigerant flow paths. Hence, the heat exchange amounts of the refrigerant in the refrigerant flow paths are not equal. For this reason, there is a demand for the heat exchanger to be configured to adjust the refrigerant passing amounts in the refrigerant flow paths in accordance with the difference in heat exchange amount. In this case, the refrigerant passing amounts in the refrigerant flow paths are not equal.

The refrigerant passing amounts in the refrigerant flow paths can be controlled by adjusting the pressure losses in the capillaries connected between the distributor and the refrigerant flow paths, as in Patent Literature 1. That is, the refrigerant passing amounts in the refrigerant flow paths can be controlled by adjusting the lengths and inner diameters of the capillaries. However, pressure-loss adjusting methods using adjustment of the lengths of the capillaries and adjustment of the inner diameters of the capillaries have their respective advantages and disadvantages.

In adjustment using the lengths of the capillaries, the capillaries are easily distinguished and are also easily managed during production because they are clearly different in length. However, a long capillary has disadvantages. For example, it consumes much material and needs space, and a portion looped to contain the lengthy capillary is apt to vibrate.

Adjustment using the inner diameters of the capillaries has the advantage that the lengths of the capillaries can be limited to the minimum required lengths. However, the differences in inner diameter are not easily identified by appearance, and a special unit for checking with a jig, such as a gauge, without depending on visual check is necessary. Hence, management in production is complicated.

An object of the present invention is to provide a heat exchanger that allows the burden of production management to be reduced while controlling increases in length and size of capillaries, and a refrigeration cycle apparatus including the heat exchanger.

Solution to Problem

A heat exchanger according to the present invention includes a plurality of refrigerant flow paths separated by a distributor and is configured to allow a refrigerant inflow amount to each of the plurality of refrigerant flow paths to be adjusted by a pressure loss in a corresponding one of a plurality of capillaries connected between the distributor and the plurality of refrigerant flow paths. Inner diameters of the plurality of capillaries are limited to two types. An inner diameter of one type of the plurality of capillaries having a larger inner diameter is 1.3 to 1.6 times larger than an inner diameter of an other type of the plurality of capillaries having a smaller inner diameter.

A refrigeration cycle apparatus according to the present invention includes at least a compressor, a condenser, a pressure reducer, and an evaporator connected in a closed loop by a refrigerant pipe. The above heat exchanger is used as the evaporator.

Advantageous Effects of Invention

According to the heat exchanger of the present invention, the inner diameters of the plurality of capillaries are limited to two types, and the inner diameter of the capillary having a larger inner diameter is 1.3 to 1.6 times larger than the inner diameter of the capillary having a smaller inner diameter. Hence, the lengths of the capillaries can be limited to the minimum required lengths. Moreover, since the number of types of the capillaries to be managed is only two, the burden of production management can be reduced.

Further, since the refrigeration cycle apparatus of the present invention includes the above-described heat exchanger as the evaporator, the lengths of the capillaries can be limited to the minimum required lengths, thereby achieving size reduction.

BRIEF DESCRIPTION OF DRAWINGS

FIG. 2 is a table showing comparison of the inner diameter ratios and length ratios of separated capillaries in the heat exchanger of Embodiment 1 of the present invention with those of Comparative Examples.

DESCRIPTION OF EMBODIMENTS

Embodiment 1

Figure 1:
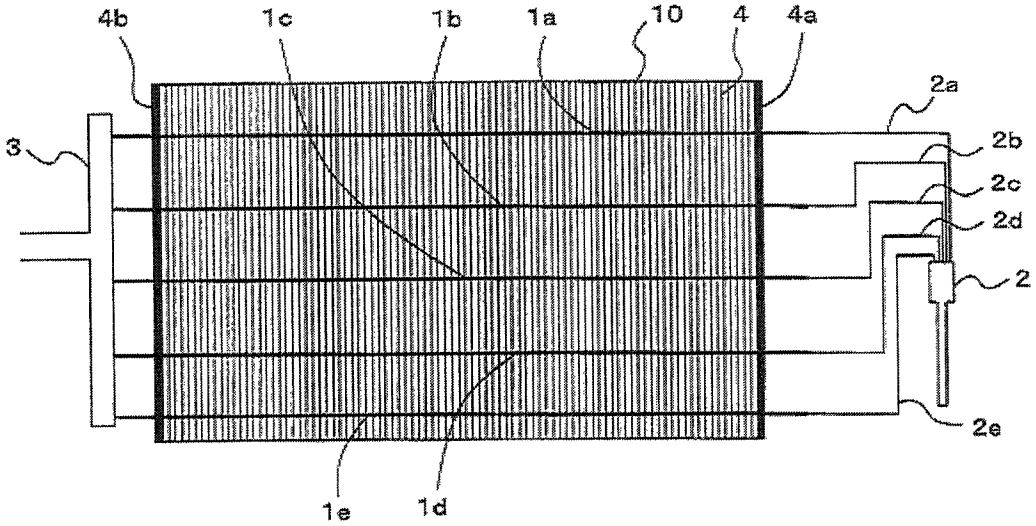
FIG. 1 is a structural view of a heat exchanger according to Embodiment 1 of the present invention.

First, the principle of the present invention will be described. The pressure loss of a capillary with respect to the refrigerant circulation amount is directly proportional to the length of the capillary. With respect to the inner diameter of the capillary, the pressure loss is proportional to the −4.75th power of the inner diameter when calculated according to the following four calculation formulas that are generally known.

$$\Delta P=\lambda\times L/D\times(\gamma\times V^2)/2 \quad (1)$$

Formula (1) above is the Darcy-Weisbach Equation.

Here, ΔP represents the pressure loss, λ represents the tube friction coefficient, L represents the tube length, D represents the inner diameter of the capillary, γ represents the fluid density, and V represents the tube flow velocity. λ is given by Formula (2) below.

$$\lambda=0.3164/Re^{0.25} \quad (2)$$

Formula (2) above is the Blasius Equation.

Here, Re represents the Reynolds number. Re is given by Formula (3) below.

$$Re=(\gamma\times V\times D)/\mu \quad (3)$$

Here, μ represents the fluid kinematic viscosity. The tube flow velocity V is given by Formula (4) below.

$$V=Q/(\pi\times D/2)^2) \quad (4)$$

Here, Q represents the fluid flow rate.

When the inner diameters of capillaries are limited to two types, high efficiency is obtained by setting the difference in inner diameter at the ratio of 1.3 to 1.6 times in the following context.

That is, in most cases, the difference in heat exchange amount between the refrigerant flow paths in the heat exchanger is kept within 3 times or less. Conversely, in a case in which the difference exceeds 3 times, it is more important to distribute the routes of the refrigerant flow paths than to distribute the refrigerant flow rates by the capillaries.

When a difference of 3 times needs to be made in the refrigerant flow rate according to the heat exchange amount, it is necessary to make a maximum difference of about 9 times in pressure loss between the capillaries. The difference in pressure loss between the capillaries can be adjusted by the inner diameters of the capillaries or the lengths of the capillaries.

When a difference of 1.6 times in inner diameter is made between the capillaries, since the pressure loss is proportional to the −4.75th power of the inner diameter, as described above, a pressure loss difference of about 9.3 times can be made as long as the capillaries have the same length. For this reason, the dimensional relationship that can respond to the required maximum pressure difference can be obtained only by the difference in inner diameter. To make more difference in the inner diameter, the necessity to increase the pressure losses by the lengths of the capillaries by extending the length of a capillary having a larger inner diameter (a smaller pressure loss) to balance with a capillary having an inner diameter with a larger pressure loss (having a smaller inner diameter), that is, to limit the pressure loss difference to a maximum of about 9 times. In this case, the total dimension of the capillaries increases, causing the increase in consumption of the material, enlargement of the required structural space, and thus increase in size, which is not efficient.

When a difference of 1.3 times is made between the inner diameters of the capillaries, since the pressure loss is proportional to the −4.75th power of the inner diameter, as described above, a pressure loss difference of about 3.5 times can be made as long as the capillaries have the same length. When the pressure loss difference becomes about 3 times, which is less than about 3.5 times, it is unnecessary to make the capillary lengths so long even in adjustment using only the lengths of the capillaries, and an arrangement can easily be made. For this reason, it is unnecessary to complicate production management by making difference in the inner diameter. That is, to make difference in pressure loss between the capillaries while limiting the lengths of the capillaries, it is efficient to control the pressure losses of the capillaries by adjusting the inner diameters of the capillaries as much as possible and to finely adjust the pressure losses by the lengths of the capillaries.

Next, the present invention will be described in conjunction with illustrated Embodiment 1.

FIG. 1 is a structural view of a heat exchanger according to Embodiment 1 of the present invention.

As illustrated in FIG. 1, in a heat exchanger 10 according to Embodiment 1, multiple cooling fins 4 are arranged at a predetermined interval and in multiple layers between a pair of right and left tube plates 4*a* and 4*b*, and heat transfer tubes 1*a*, 1*b*, 1*c*, 1*d*, and 1*e* serving as refrigerant flow paths are attached in multiple rows to penetrate the multiple cooling fins 4 in the plate thickness direction. The heat transfer tubes 1*a*, 1*b*, 1*c*, 1*d*, and 1*e* are connected at one end (here, at an end portion on a refrigerant inflow side when the heat exchanger functions as an evaporator) to a distributor 2, respectively, via capillaries 2*a*, 2*b*, 2*c*, 2*d*, and 2*e*. The heat transfer tubes 1*a*, 1*b*, 1*c*, 1*d*, and 1*e* are connected at the other end (at an end portion on a refrigerant outflow side when the heat exchanger functions as an evaporator) to a header 3.

FIG. 2 is a table showing comparison of the inner diameter ratios and length ratios of separated capillaries in the heat exchanger of Embodiment 1 of the present invention with those of Comparative Examples.

Here, the heat exchange amounts of the heat transfer tubes 1*a*, 1*b*, 1*c*, 1*d*, and 1*e* are shown as 30%, 25%, 20%, 15%, and 10%, respectively, so that a difference of 3 times is made between the largest and smallest ones of the heat exchange amounts of the heat transfer tubes 1*a*, 1*b*, 1*c*, 1*d*, and 1*e*. These heat exchange amounts sum up to 100%.

Here, it is assumed that the length of the shortest one of the capillaries 2*a*, 2*b*, 2*c*, 2*d*, and 2*e* is determined under structural constraints, and the ratios of the lengths of the other capillaries to the length of the shortest capillary are shown.

In Comparative Example A, capillaries having the same inner diameter are used. Since the length is determined in proportional to the ratio of the required pressure loss, the length of the capillary 2*e* corresponding to the heat transfer tube 1*e* with a small heat exchange amount is as long as 9 times longer than the minimum length.

In Example of Embodiment, two types of inner diameters are used for the capillaries 2*a*, 2*b*, 2*c*, 2*d*, and 2*e* so that the total capillary length becomes short. The inner diameters of the capillaries 2*a*, 2*b*, 2*c*, and 2*d* are 1.6 times larger than the inner diameter of the capillary 2*e*, and the ratio of the pressure loss to the capillary length in the capillary 2*e* is about 9. The length of the capillary 2*e* required to provide the pressure loss is made shorter than in Comparative Example A.

Comparative Example B is a case in which two types of inner diameters are used for the capillaries 2*a*, 2*b*, 2*c*, 2*d*, and 2*e*, similarly to Example of Embodiment described above and in which the inner diameter difference is more than an inner diameter difference of 1.6 times that is required to correspond to the maximum refrigerant flow rate difference of 3 times defined in the present invention. As a result of setting the inner diameter difference at 1.8 times, the required lengths of the capillaries 2*a*, 2*b*, 2*c*, and 2*d* having a large inner diameter (that is, a small pressure loss) and having a large refrigerant amount have to be increased so that the pressure loss difference becomes about 9 times. That is, it is shown that, in Comparative Example B, the total length of the capillaries 2*a*, 2*b*, 2*c*, 2*d*, and 2*e* is not decreased even when the inner diameter difference of more than 1.6 times is made among the inner diameters of the capillaries 2*a*, 2*b*, 2*c*, 2*d*, and 2*e*.

When two types of capillaries 2*a*, 2*b*, 2*c*, 2*d*, and 2*e* that are different in inner diameter, as in Example of Embodiment and Comparative Example B, are used, the specifications of a receiving side at an assembly portion to the distributor 2 can be standardized by using the same outer diameter. For this reason, the distributor 2 can be commonly used in various types of devices.

Here, using the same outer diameter in the capillaries 2*a*, 2*b*, 2*c*, 2*d*, and 2*e* having different inner diameters means that a difference in thickness is made among the capillaries 2*a*, 2*b*, 2*c*, 2*d*, and 2*e*. When the capillaries 2*a*, 2*b*, 2*c*, 2*d*, and 2*e* are assembled to the distributor 2 by brazing, in consideration of the influence of the heat capacity difference due to the thickness difference among the capillaries 2*a*, 2*b*, 2*c*, 2*d*, and 2*e*, it is preferable to sort the capillaries 2*a*, 2*b*, 2*c*, 2*d*, and 2*e* by thicknesses and to collectively dispose the capillaries having the same thickness to the distributor 2. This facilitates adjustment in production, for example, adjustment of the heating time in brazing.

When two types of capillaries 2*a*, 2*b*, 2*c*, 2*d*, and 2*e* having different inner diameters are used, as in Example of Embodiment and Comparative Example B, preferably, marking or no marking is provided or different marking colors are used so that the difference in inner diameter can be identified only by visually checking the appearance during assembly in production.

In the heat exchanger 10 of Embodiment 1 having the above structure, the refrigerant passing through the heat exchanger 10 is divided and flows through the separated heat transfer tubes 1*a*, 1*b*, 1*c*, 1*d*, and 1*e* between the distributor 2 and the header 3 that are disposed on outer sides of the tube plates 4*a* and 4*b*. The refrigerant flow rates in the heat transfer tubes 1*a*, 1*b*, 1*c*, 1*d*, and 1*e* are adjusted by the capillaries 2*a*, 2*b*, 2*c*, 2*d*, and 2*e* that connect the distributor 2 and the heat transfer tubes 1*a*, 1*b*, 1*c*, 1*d*, and 1*e*.

According to the heat exchanger 10 of Embodiment 1, the inner diameters of the plurality of capillaries 2*a*, 2*b*, 2*c*, 2*d*, and 2*e* are limited to two types. The inner diameter of the capillary having a larger inner diameter is set at 1.3 to 1.6 times larger than the inner diameter of the capillary having a smaller inner diameter. Hence, the lengths of the capillaries 2*a*, 2*b*, 2*c*, 2*d*, and 2*e* can be limited to the minimum required lengths. Further, the types of the capillaries 2*a*, 2*b*, 2*c*, 2*d*, and 2*e* to be managed are limited to only two types, thereby reducing the burden of production management.

Embodiment 2

Figure 3:
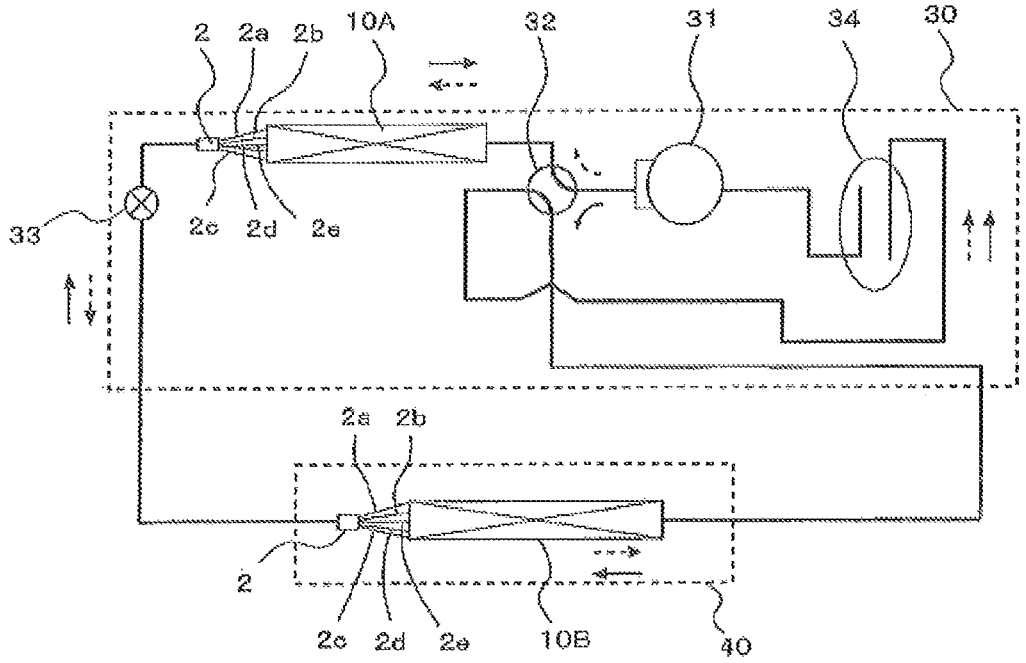
FIG. 3 is a refrigerant circuit diagram of a refrigeration cycle apparatus including a heat exchanger according to Embodiment 2 of the present invention.

FIG. 3 is a refrigerant circuit diagram of a refrigeration cycle apparatus, such as an air-conditioning apparatus, including a heat exchanger of Embodiment 2 of the present invention during cooling operation. In the diagram, portions corresponding to those of Embodiment 1 described above are denoted by the same reference signs. FIG. 1 above is referred to for the description.

As illustrated in FIG. 3, a refrigeration cycle apparatus of Embodiment 2, for example, an air-conditioning apparatus, includes a compressor 31, a four-way switch valve 32 for switching the flow of refrigerant from the compressor 31, an outdoor heat exchanger 10A that serves as a radiator (condenser) from which inner refrigerant rejects heat during cooling operation and serves as an evaporator from which inner refrigerant evaporates during heating operation (heating driving), and an electronic expansion valve (pressure reducer) 33 that reduces the pressure of a refrigerant passing therethrough. The refrigeration cycle apparatus further includes an indoor heat exchanger 10B that serves as an evaporator from which inner refrigerant evaporates during cooling operation (cooling driving) and serves as a radiator (condenser) from which inner refrigerant rejects heat during heating operation, and an accumulator 34 connected to a suction-side pipe of the compressor 31. The compressor 31, the four-way switch valve 32, the outdoor heat exchanger 10A, the electronic expansion valve 33, the indoor heat exchanger 10B, and the accumulator 34 are connected in order by refrigerant pipes. The accumulator 34 has the functions of storing an extra refrigerant in the refrigeration cycle and preventing the compressor 31 from being broken by return of much refrigerant liquid to the compressor 31.

In Embodiment 2, the compressor 31, the four-way switch valve 32, the outdoor heat exchanger 10A, the electronic expansion valve 33, and the accumulator 34 are stored in an outdoor unit 30, and the indoor heat exchanger 10B is stored in an indoor unit 40.

As illustrated in FIG. 1, in each of the outdoor heat exchanger 10A and the indoor heat exchanger 10B, heat transfer tubes 1*a*, 1*b*, 1*c*, 1*d*, and 1*e* are connected at one end (at an end portion on the inflow side of the refrigerant when the heat exchanger functions as an evaporator) to a distributor 2, respectively, via capillaries 2*a*, 2*b*, 2*c*, 2*d*, and 2*e*. Further, the heat transfer tubes 1*a*, 1*b*, 1*c*, 1*d*, and 1*e* are connected at the other end (at an end portion on the outflow side of the refrigerant when the heat exchanger functions as an evaporator) to a header 3. As described above, inner diameters of the capillaries 2*a*, 2*b*, 2*c*, 2*d*, and 2*e* are limited to two types. The capillary having a larger inner diameter has an inner diameter that is 1.3 to 1.6 times larger than the inner diameter of the capillary having a smaller inner diameter.

Next, the operations of the refrigeration cycle apparatus, such as the air-conditioning apparatus, having the above-described configuration will be described in the order of cooling operation and heating operation with reference to FIG. 3.

When the cooling operation is started, the four-way switch valve 32 is switched so that the refrigerant flows from the compressor 31 to the outdoor heat exchanger 10A. Thus, a high-temperature and high-pressure refrigerant compressed by the compressor 31 flows into the outdoor heat exchanger 10A, and is condensed and liquefied. After that, the refrigerant is expanded by the electronic expansion valve 33 into a low-temperature and low-pressure two-phase state. The refrigerant flows to the indoor heat exchanger 10B, is evaporated and gasified, passes through the four-way switch valve 32 and the accumulator 34, and returns to the compressor 31 again. That is, the refrigerant circulates, as shown by dotted arrows in FIG. 3.

Next, the heating operation will be described. When the heating operation is started, the four-way switch valve 32 is switched so that the refrigerant flows from the compressor 31 to the indoor heat exchanger 10B. Thus, a high-temperature and high-pressure refrigerant compressed by the compressor 31 flows to the indoor heat exchanger 10B, is condensed, and is liquefied. After that, the refrigerant is expanded by the electronic expansion valve 33 into a low-temperature and low-pressure two-phase state, flows to the outdoor heat exchanger 10A, is evaporated and gasified, passes through the four-way switch valve 32 and the accumulator 34, and returns to the compressor 31 again. That is, when the cooling operation is switched to the heating operation, the indoor heat exchanger 10B is switched from the evaporator to the condenser, the outdoor heat exchanger 10A is switched from the condenser to the evaporator, and the refrigerant circulates, as shown by solid arrows in FIG. 3.

In the refrigeration cycle apparatus of Embodiment 2, the above-described heat exchanger 10 of Embodiment 1 is used as the outdoor heat exchanger 10A or the indoor heat exchanger 10B serving as the evaporator. Hence, it is possible to limit the lengths of the capillaries to the minimum required lengths and to achieve size reduction.

REFERENCE SIGNS LIST

1*a*, 1*b*, 1*c*, 1*d*, 1*e* heat transfer tube (refrigerant flow path),
2 distributor
2*a*, 2*b*, 2*c*, 2*d*, 2*e* capillary
3 header
4 cooling fin
4*a*, 4*b* tube plate
10 heat exchanger
10A outdoor heat exchanger
10B indoor heat exchanger
30 outdoor unit
31 compressor
32 four-way switch valve
33 electronic expansion valve (pressure reducer)
34 accumulator
40 indoor unit

The invention claimed is:

1. A heat exchanger comprising a plurality of refrigerant flow paths separated by a distributor, the heat exchanger is configured to allow a refrigerant inflow amount to each refrigerant flow path of the plurality of refrigerant flow paths to be adjusted by a pressure loss in a corresponding one capillary of a plurality of capillaries which is connected between the distributor and the each refrigerant flow path of the plurality of refrigerant flow paths, inner diameters of the plurality of capillaries being limited to two types, an inner diameter of one type of the plurality of capillaries having a larger inner diameter being 1.3 to 1.6 times larger than an inner diameter of another type of the plurality of capillaries having a smaller inner diameter, wherein there are at least three capillaries in the plurality of capillaries, wherein the capillaries having the larger inner diameter all have the same larger inner diameter and have different lengths.

2. The heat exchanger of claim 1, wherein outer diameters of the plurality of capillaries are standardized to a same outer diameter.

3. The heat exchanger of claim 2, wherein the plurality of capillaries are sorted into the two types corresponding to the inner diameters and disposed to the distributor.

4. The heat exchanger of claim 1, wherein the two types of the plurality of capillaries having different inner diameter are marked in different colors corresponding to the types.

5. The heat exchanger of claim 1, wherein one of the two types of the plurality of capillaries having the different inner diameters is provided with a marking.

6. A refrigeration cycle apparatus comprising at least a compressor, a condenser, a pressure reducer, and an evaporator connected in a closed loop by a refrigerant pipe, wherein the heat exchanger of claim 1 is used as the evaporator.

7. The heat exchanger of claim 2, wherein the two types of the plurality of capillaries having different inner diameter are marked in different colors corresponding to the types.

8. The heat exchanger of claim 3, wherein the two types of the plurality of capillaries having different inner diameter are marked in different colors corresponding to the types.

9. The heat exchanger of claim 2, wherein one of the two types of the plurality of capillaries having the different inner diameters is provided with a marking.

10. The heat exchanger of claim 3, wherein one of the two types of the plurality of capillaries having the different inner diameters is provided with a marking.

* * * * *